US007243707B2

(12) United States Patent
Brost et al.

(10) Patent No.: US 7,243,707 B2
(45) Date of Patent: Jul. 17, 2007

(54) FLAT TUBE EXHAUST HEAT EXCHANGER WITH BYPASS

(75) Inventors: Viktor Brost, Aichtal (DE); Christoph Ruf, Metzingen (DE)

(73) Assignee: Modine Manufacturing Company, Racine, WI (US)

( * ) Notice: Subject to any disclaimer, the term of this patent is extended or adjusted under 35 U.S.C. 154(b) by 49 days.

(21) Appl. No.: 11/201,783

(22) Filed: Aug. 11, 2005

(65) Prior Publication Data

US 2006/0032613 A1 Feb. 16, 2006

(30) Foreign Application Priority Data

Aug. 14, 2004 (EP) ..... 0419339

(51) Int. Cl.
*F28F 27/02* (2006.01)

(52) U.S. Cl. ..... 165/103; 165/297; 165/DIG. 110

(58) Field of Classification Search ..... 165/103, 165/164–167, 280, 283, 297, DIG. 109, DIG. 119, 165/DIG. 110
See application file for complete search history.

(56) References Cited

U.S. PATENT DOCUMENTS 6,141,961 A 11/2000 Rinckel
6,213,105 B1 4/2001 Banzhaf et al.
6,250,380 B1 6/2001 Strahle et al.
7,032,577 B2 * 4/2006 Rosin et al. ..... 165/172
2005/0006060 A1 1/2005 Brost et al.

FOREIGN PATENT DOCUMENTS

| | | | |
|---|---|---|---|
| DE | 197 33 964 | A1 | 2/1999 |
| DE | 199 06 401 | C1 | 8/2000 |
| DE | 199 62 863 | A1 | 6/2001 |
| DE | 101 42 539 | A1 | 3/2003 |
| DE | 103 28 638 | A1 | 1/2005 |
| EP | 0 916 837 | A2 | 10/1998 |
| EP | 0 987 427 | | 7/1999 |
| EP | 0 992 756 | B1 | 9/1999 |
| EP | 0942 156 | A1 | 9/1999 |
| EP | 1 376 042 | A2 | 4/2003 |
| EP | 1 491 837 | A2 | 4/2004 |

* cited by examiner

*Primary Examiner*—Teresa J. Walberg
(74) *Attorney, Agent, or Firm*—Michael Best & Friedrich LLP

(57) ABSTRACT

A heat exchanger including flat tubes having cooling passages for a gas and a bypass for the gas separate from the cooling passages, and coolant channels defined between every two flat tubes adjacent the tube passages and spaced from the bypass of the tubes. The tubes define a cooled area adjacent the passages and an uncooled area adjacent the bypass substantially spaced from the channels.

14 Claims, 5 Drawing Sheets

FLAT TUBE EXHAUST HEAT EXCHANGER WITH BYPASS

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a heat exchanger and more particularly to a heat exchanger in which gas may be selectively cooled or not cooled by a coolant.

BACKGROUND OF THE INVENTION AND TECHNICAL PROBLEMS POSED BY THE PRIOR ART

Heat exchangers used with recirculating exhaust gas are highly advantageous in that they reduce emissions in vehicles. Recycled exhaust must be cooled in order to achieve high efficiency during recirculation, especially to achieve better degrees of filling. However, it will be appreciated by those skilled in the art that the entire system (vehicle with internal combustion engine) and an overall energy balance are at issue. Toward that end, all operating phases in vehicles have heretofore been analyzed to account for alternating loads which may be encountered. One known measure to account for alternating loads involves bypassing the exhaust heat exchangers in phases in which cooling of the exhaust would be counterproductive (e.g., during the starting phases of the vehicle, which require an extremely large amount of fuel and in which the heat energy of the exhaust may be used to rapidly heat the engine to its optimal operating temperature). For example, bypassing the exhaust heat exchanger for such purposes is shown in European patent application/patents EP 916 837 (see also U.S. Pat. No. 6,213,105 B1) and EP 987 427, wherein an integrated valve in front of the exhaust entry to the exhaust heat exchanger allows the exhaust stream to be selectively diverted toward the exhaust heat exchanger or to bypassing the heat exchanger and passing directly into the recirculation line.

Additional solutions have been described in German Applications DE 197 33 964 A1 and DE 199 06 401 A1. In the first named document, a bypass line and the exhaust heat exchanger are separated from each other but both are arranged in a common housing. In the latter document, the bypass line passes around the exhaust heat exchanger on the outside without both being enclosed by a housing. In the exhaust heat exchangers themselves, so-called tube-bundle heat exchangers or coil-tube heat exchangers appear to be involved. Such heat exchangers are a special design which is not particularly compact or space-saving, and therefore disadvantageous in that respect if used in vehicle engine compartments where space is limited.

Exhaust heat exchangers have also been long used to heat the passenger compartments of vehicles, and have also generally required bypassing, among other things, because the heating demand is not permanently present. Such exhaust heat exchangers have also usually been of the tube-bundle type or coil-tube type, and include exhaust heat exchangers such as can be deduced from EP 942 156 A1 (see also U.S. Pat. No. 6,141,961), for example.

Additional solutions with integrated bypasses have been described in DE 101 42 539 A1 and in DE 199 62 863 A1, which disclose heat exchangers produced by demanding welding methods, are not particularly compact, and which require a fairly demanding bypass design.

The present invention is directed toward overcoming one or more of the problems set forth above.

SUMMARY OF THE INVENTION

In one aspect of the present invention, a heat exchanger is provided, including flat tubes having cooling passages for a gas and a bypass for the gas separate from the cooling passages, and coolant channels defined between every two flat tubes adjacent the tube passages and spaced from the bypass of the tubes. The tubes define a cooled area adjacent the passages and an uncooled area adjacent the bypass substantially spaced from the channels.

In one form of this aspect of the present invention, the flat tubes are one piece and stacked one over the other with intermediate spaces forming the channels, and the heat exchanger further includes a housing about the flat tubes. In one further form, the flat tubes have embossings spacing adjacent flat tubes. In another further form, inserts are provided between the flat tubes separating the coolant channels from the uncooled area.

In another form of this aspect of the present invention, the flat tubes are formed from two shaped plates in which the channels and at least one bypass are formed and the heat exchanger is housingless. In a further form, the shaped plates include embossings strengthening the channels. In another further form, the shaped plates have a continuous lip with which two adjacent plates are connected to each other and the coolant channel is surrounded by the connected lips and, in a still further form, the lip along the uncooled area is wider than the lip on the other sides of the channel.

In still another form of this aspect of the present invention, an inlet collecting tank and an outlet collecting tank for the gas are at the ends of the flat tubes.

In yet another form of this aspect of the present invention, internal inserts are provided in the flat tubes in the cooled area. In a further form, the internal inserts are corrugated and each form discrete flow passages for the gas and, in a still further form, the discrete flow passage adjacent the bypass is substantially blocked to gas flow to suppress heat transfer between the cooled area and the uncooled area. In another further form, an inlet collecting tank and an outlet collecting tank for the gas are at the ends of the flat tubes, wherein the bypass and cooled area are separated by a portion of the internal inserts and a separation sheet in one of the inlet and outlet collecting tanks and, in a still further form, the separation sheet is an integral part of the collecting tank.

DETAILED DESCRIPTION OF THE INVENTION

Figure 1:
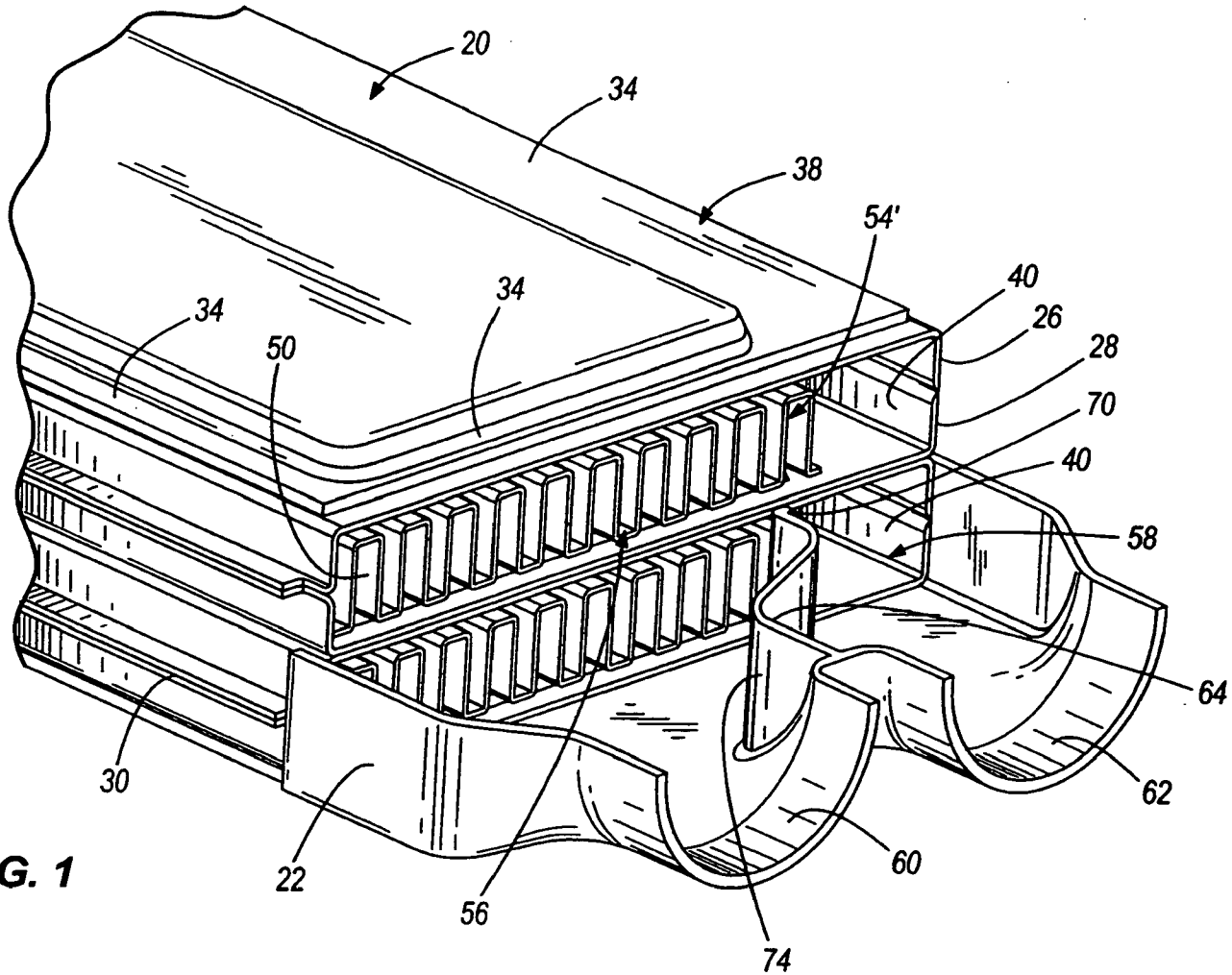
FIG. 1 is a perspective, cut-away view of part of a heat exchanger according to the present invention.

A perspective, partially cut-away view of part of the heat exchanger according to the invention is depicted in FIG. 1 for use in cooling gas such as exhaust or charge air. The heat exchanger may be incorporated in a suitable fashion, for example, in an exhaust gas recirculation system (not shown). In the practical example illustrated in FIG. 1, only two flat tubes 20 are stacked one on the other and each provided with collecting tanks 22, 24 on the ends of the heat exchanger (see FIG. 2). It should, of course, be understood that although only two flat tubes are shown in the Figures, more than two flat tubes 20 can be used in the scope of the present invention depending, for example, on the heat exchange requirements of the system with which it may be used.

The flat tubes 20 may be advantageously assembled from two identically shaped plates 26, 28, with one of the plates 26 or 28 then rotated 180° around the longitudinal axis relative to the other. The plates 26, 28 may be advantageously soldered together at the edge 30 along the longitudinal axis of plates 26, 28.

The plates 26, 28 are shaped with an outer lip 34 which surrounds an offset portion to form at least one channel 36 for coolant between the plates 26, 28 of adjacent flat tubes 20. (EP 992 756 B1 and corresponding U.S. Pat. No. 6,250,380 B1, the disclosures of which are hereby fully incorporated by reference, disclose, interalia, a structure including a lip as with the present invention. Further, EP Publication 1 376 043 A2 [Application No. 03 007 724.2] is also incorporated by reference, and discloses, inter alia, a diffuser or collecting tank such as may also be used with the present invention. In each reference, two shaped plates are assembled to form a flat tube and the flat tubes are assembled into a stack to enclose channels for flow of a coolant between the tubes. German Application DE 103 28 638 and European Publication EP 1 491 837 A2 [file number EP 4009615.8] [and corresponding U.S. patent Publication No. 2005/006060 A1] also disclose similar structures, and their disclosures are also incorporated herein by reference.)

The lip 34 of the present invention may advantageously be wider on one long side 38 of the heat exchanger so that the plates 26 or 28 lie flat against each other there (see, e.g., FIGS. 4–7).

Bypasses 40 are formed in the flat tubes 20 adjacent the wider portion of the lips 34. The exhaust may be guided through the bypasses 40 when cooling of the exhaust by the coolant is not desired. While the bypasses 40 are separate as illustrated in the Figures, they may also be considered to be one bypass 40 which is divided several times. It should be understood, for example, that the outer lips 34 adjacent the bypasses could have one or more cutouts which eliminate any division into "several bypasses". Further, while all of the flat tubes 20 may advantageously be formed with a bypass 40, although it would be within the scope of the present invention to provide bypasses in less than all the tubes.

Figure 3:
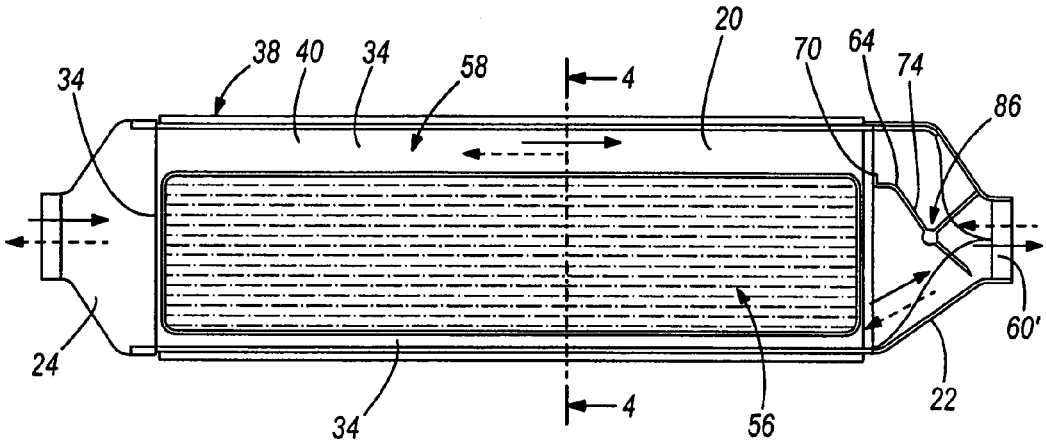
FIG. 3 is an alternative view to FIG. 2 with a flap valve in the collecting tank.

It should also be understood that an additional bypass (not shown) could be formed on the other long side 38 of the flat tubes 20 by appropriate formation of plates 26, 28 (e.g., in the lower section as oriented in FIG. 3).

Wave-like internal inserts 50 are inserted into the flat tubes 20 to define flow passages 54 for the exhaust. The flow passages 54 may advantageously be discrete, for example, by soldering the inserts 50 to the tube walls along the length of the tubes 20 at each crest. The internal inserts 50 extend in the longitudinal direction of flat tubes 20 over roughly their entire length, but only over the cooled area 56 of flat tubes 20 in the transverse direction. In this respect the cooled area 56 is delimited from the uncooled area 58 by the internal inserts 50, with the uncooled area 58 being the location of the bypasses 40.

Figure 2:
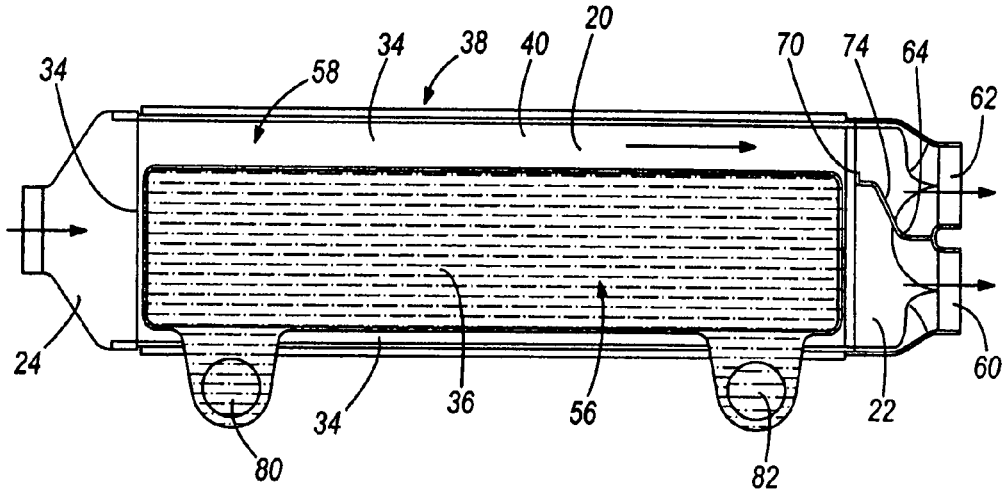
FIG. 2 is a horizontal section through the FIG. 1 heat exchanger with collecting tank.

In the embodiment illustrated in FIGS. 1 and 2, the distribution of exhaust to the cooled area 56 and/or the uncooled area 58 (bypasses 40) is achieved outside of the heat exchanger by a switching valve (not shown) which, for example, may be operated to selectively close either connector 60 or connector 62 of collecting tank 22. A separation sheet 64 is integrated in collecting tank 22, and includes a protruding foot 70 (see FIGS. 7–8) at the last wave of the insert 50 defining the last passage 54' facing the bypass 40 so as to close that last passage 54'. While the other insert defined passages 54 may advantageously be discrete but need not be so, it is particularly advantageous that the last passage 54' be discrete so that heat transfer from the cooled area 56 to the uncooled area 58 (bypass 40) is minimized by the air contained in the last passage 54'.

The bent wall portion 74 of the separation sheet 64 faces the collecting tank 22 and is firmly soldered to the collecting tank 22 at the separation of the two connectors 60 and 62.

Figure 6:
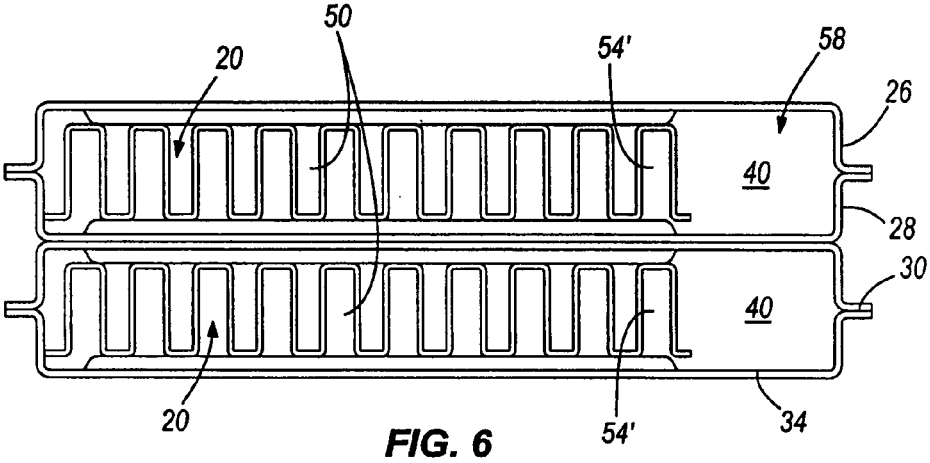
FIG. 6 is a view of the front end of the heat exchanger without the collecting tank.
Figure 7:
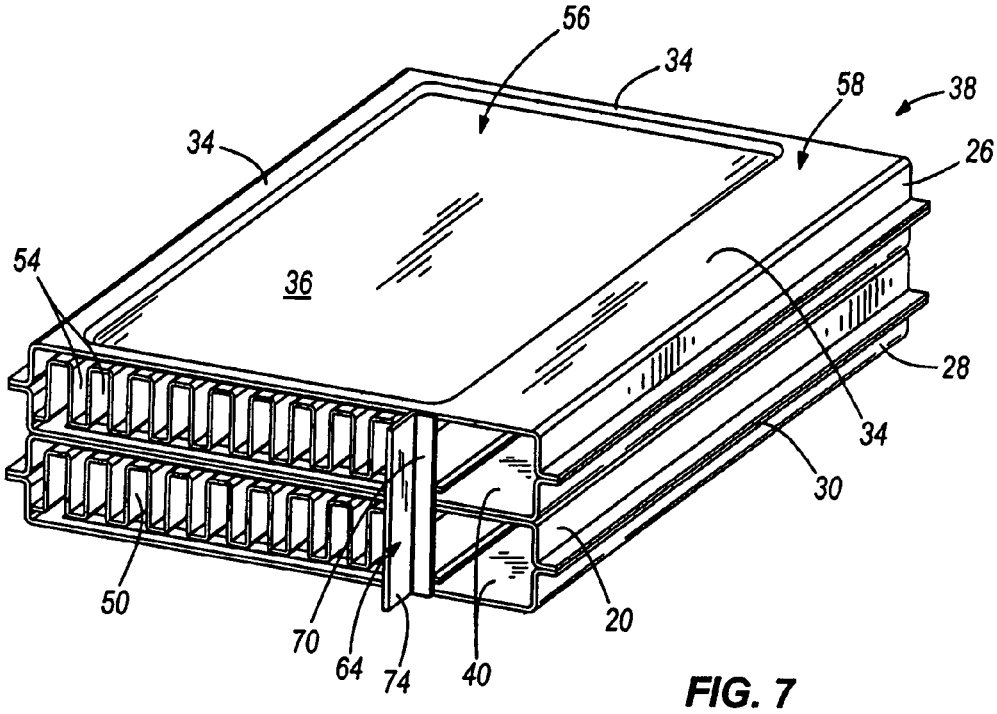
FIG. 7 is a perspective view of two flat tubes with the separation sheet.
Figure 8:
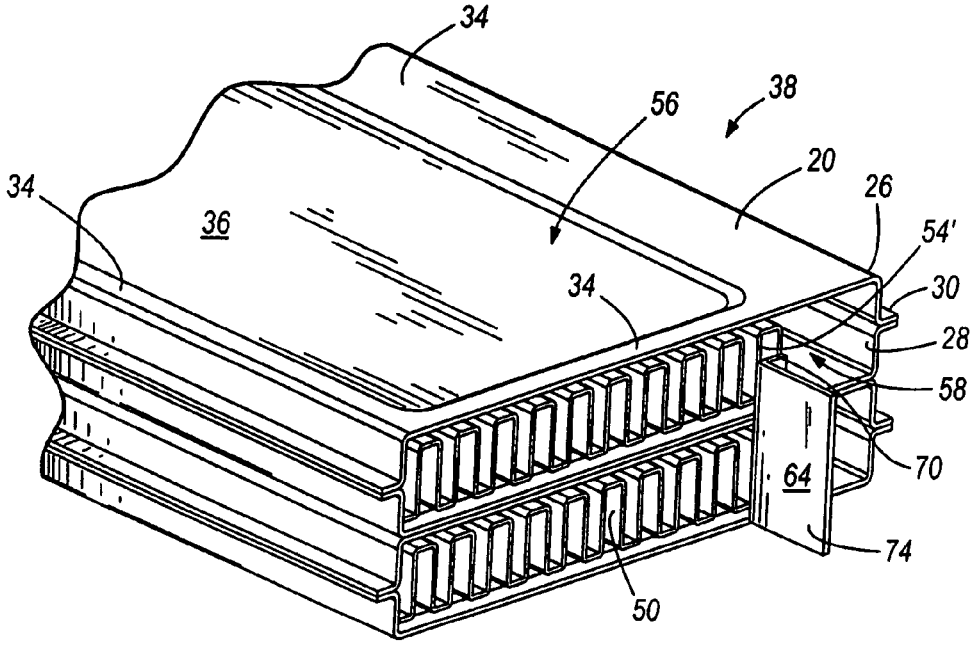
FIG. 8 is similar to FIG. 7 with the separation sheet cut away.

FIG. 6 illustrates a front view of the end of the heat exchanger without the separation sheet 64 and without the collecting tanks 22, 24. The last discrete flow passage 54' of the internal insert 50 is open in front of bypass 40 since no separation sheet 64 is mounted. FIGS. 7–8 show an end of the heat exchanger, also without the collecting tanks 22, 24, but with the separation sheet 64 mounted with its protruding foot 70 over the opening to the last passage 54' (the separation sheet 64 is cut in FIG. 8 for illustration purposes). The foot 70 tightly closes the last passage 54' against exhaust flow whereby thermal separation is provided between the uncooled area 58 and the cooled area 56.

A horizontal section through the heat exchanger of FIG. 1 with collecting tanks 22 and 24 that therefore passes through a coolant channel 36 is shown in FIG. 2 exactly in the plane of the soldering connection between two plates 26 and 28 lying against each other at their outer lips 34. This channel 36 is enclosed all the way around by the continuous lip 34, and therefore no tube bottom 90 and no enclosing housing for the heat exchanger are necessary.

The coolant is passed through the channels 36 via connectors 80 and 82, which flow may advantageously be counter-current to the flow of the exhaust. The connections 80, 82 as illustrated are advantageously positioned outside of the flow path of the exhaust (see also EP 992 756 B1 and U.S. Pat. No. 6,250,380 B1) so that flow of the exhaust is not hampered and the internal insert 50 need not be cut out. However, it should be understood that the illustrated positioning of the connections 80, 82 is merely one suitable arrangement which may be used within the scope of the present invention.

With the illustrated configuration, the cooled area 56 may be uniformly traversed by coolant flowing between connectors 80, 82 through the channels 36. Moreover, it should be appreciated that a heat exchanger such as disclosed may be easily produced in a soldering process after all parts have been assembled. However, since the switching valve (not shown) is mounted outside of the heat exchanger, the outlet of the exhaust is divided into two outlet connectors 60 and 62 for both branches, one (60) for cooled exhaust and the other (62) for uncooled exhaust (the flow path of the exhaust is shown by the flow arrows). As illustrated, the switching valve is mounted on the exhaust outlet side of the heat exchanger, although it should be appreciated that the two connectors 60, 62 (and the switch) could alternatively be on the inlet side of the exhaust.

In FIG. 3, by contrast, the switching valve 86 is incorporated into one of the collecting tanks 22 having a single outlet connector 60', with the valve 86 being suitably mounted after soldering of the heat exchanger by, for example, welding thereon. In this configuration, the bent wall 74 cooperates with the switching valve 86 in order to guarantee that no waste gas flows from uncooled area 58 into cooled area 56 and vice versa. The advantage of this structure is that an even more compact configuration of the system "heat exchanger with switching valve 86 and bypass 40 may be achieved.

Figure 4:
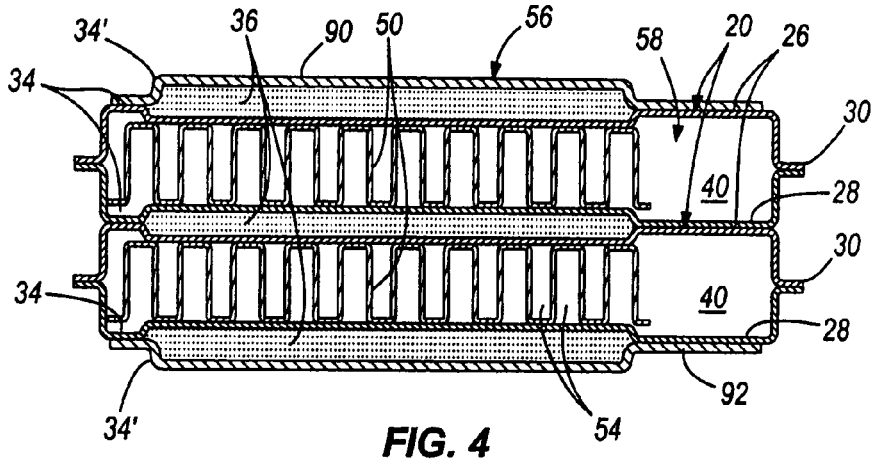
FIG. 4 is a vertical section along line IV—IV of FIG. 3.

A vertical section along IV—IV from FIG. 3 is illustrated in FIG. 4. In this structure, a cover plate 90 and a bottom plate 92 each with a continuous shaped lip 34' surrounding an offset portion are mounted to the top and bottom tubes 20, thereby forming two additional channels 36 through which coolant can flow. The cover plate 90 and bottom plate 92 may be advantageously formed from somewhat thicker sheets than the tube plates 26, 28 in order to increase the stability of the heat exchanger. The lips 34' are wide along the long side 38 adjacent the bypasses 40 so that the cover plate 90 and bottom plate 92 lie directly on flat tubes 20 in the uncooled area 58 whereby the coolant channels 36 do not extend to the uncooled area 58.

Figure 5:
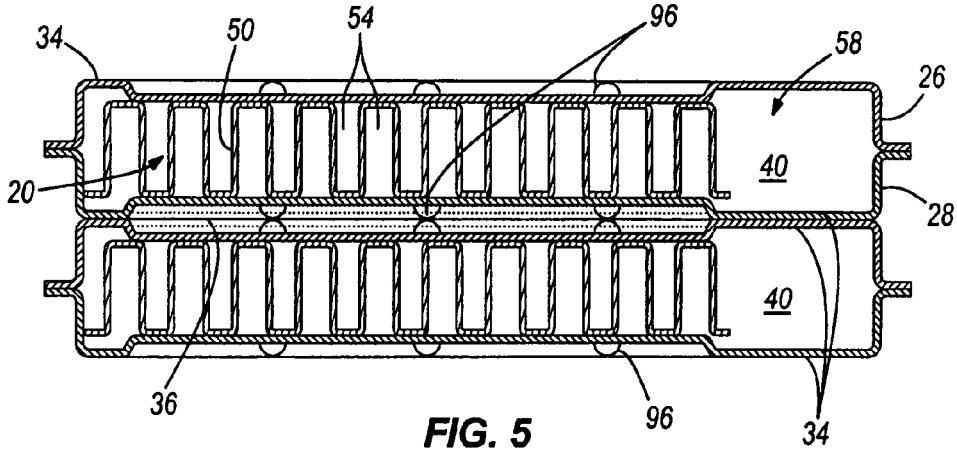
FIG. 5 is similar to FIG. 4 without cover plates and with embossments or knobs in the channels.

FIG. 5 shows an alternate practical example incorporating the present invention, wherein the cover plate and bottom plate are omitted. Embossings 96 (i.e., raised areas) are provided in the offset portions of the plates 26, 28, which embossings 96 may, on the one hand, stabilize channels 36 and, on the other hand, increase turbulence in the coolant. The embossings 96 may be, for example, knob-like or bead-like, and their number may be selected according to the size and stability requirements of the heat exchanger.

Figure 9:
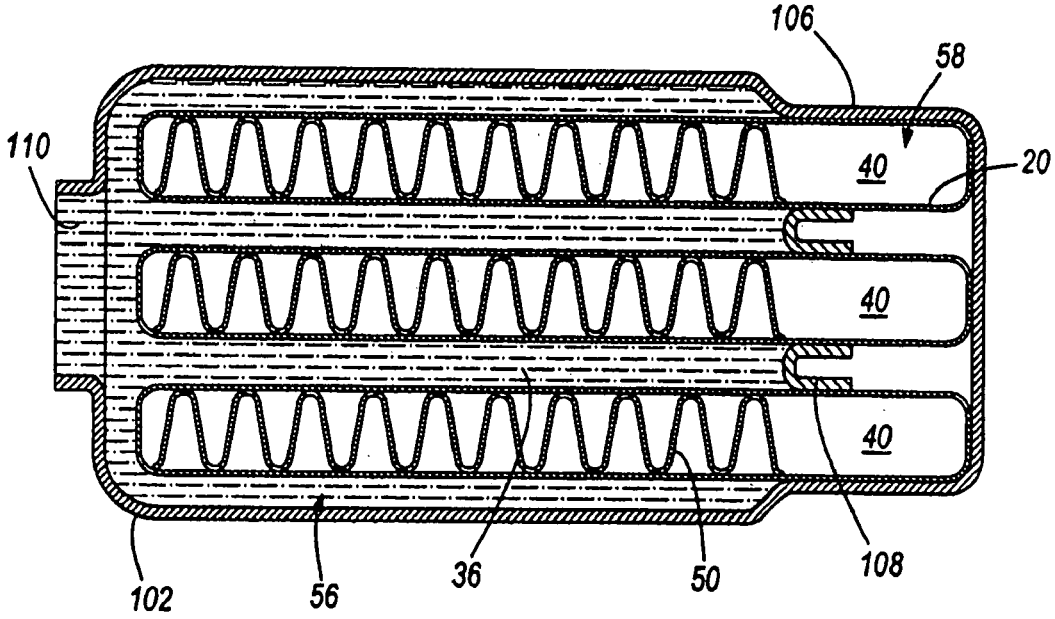
FIG. 9 is a vertical section (similar to FIGS. 4–5) of an alternative embodiment having a housing.
Figure 10:
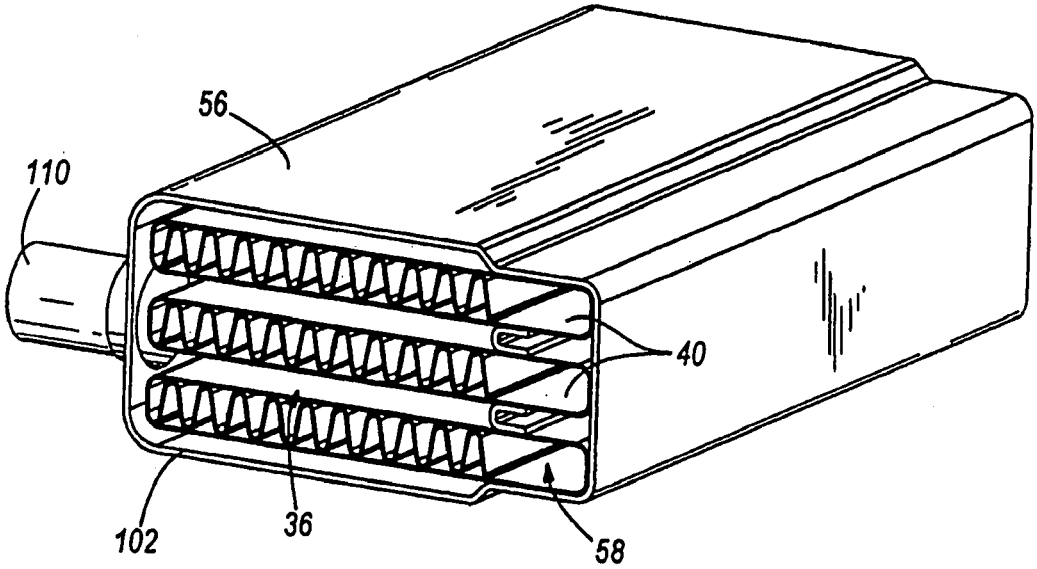
FIG. 10 is a perspective view of the FIG. 9 embodiment, without the collecting tanks.

FIGS. 9 and 10 illustrate yet another practical example incorporating the present invention, wherein the tubes are single piece welded flat tubes 20, enclosed in a housing 102. Embossings such as previously described (not shown) may also be advantageously provided, preferably in the cooled areas, in order to strengthen the channels 36 between the flat tubes 20 and between the flat tubes 20 and the housing 102.

In the FIGS. 9–10 embodiment, three flat tubes 20 are stacked one on the other with the housing 102 therearound. Channels 36 are defined between the tubes 20 and housing 102. Corrugated internal inserts 50 are in each flat tube 20 in the cooled area 56 and, to prevent coolant from flowing around the uncooled area 58 (consisting of several individual bypasses 40), the housing 102 is formed with a shoulder 106 which lies directly on flat tubes 20 in that area 58. Suitable inserts 108 are advantageously disposed between the flat tubes 20 to form barriers between the channels 36 and the uncooled area 58 to provide separation of the cooled and uncooled areas 56 and 58.

Inlet and outlet connectors (one of which is shown as 110) for the coolant can be mounted laterally, as shown in FIGS. 9 and 10, or also on the top and/or on the bottom on housing 102.

It should be appreciated that the housing 102 could be formed without the shoulder 106 and similar inserts placed between housing 102 and the outer flat tubes 20 to keep coolant from uncooled area 58 on the top and bottom of the heat exchanger (of the FIG. 9 orientation). It should further be appreciated that the housing 102 could also be designed in two parts with a connection seam suitably secured together (e.g., by soldering).

Collecting tanks 22, 24 and tube bottoms are provided on the ends of the heat exchanger for exhaust gas. Tube bottoms, such as is known, may have openings corresponding to the periphery of flat tubes 20 with whose edge the ends of the flat tubes 20 are tightly connected. Flow of gas from collecting tanks 22 or 24 into the flat tubes 20 is ensured by this and separation relative to the channels 36 for the coolant is simultaneously guaranteed. The periphery of the tube bottom is connected to the housing 102, and the separation sheet 64 in the collecting tanks 22, 24 separates the cooled from the uncooled exhaust in the collecting tanks 22, 24. Either of the previously described switch variants may be advantageously used (i.e., either with the switching valve 86 integrated in one of the collecting tanks 22, 24, or with two outlet connectors 60 and 62 and the switch external of the heat exchanger, with the separation sheet 64 designed accordingly).

Not shown in FIGS. 9 and 10, but useful, depending on the size of the heat exchanger, are embossings which space the flat tubes 20 (such as shown and described in connection with FIG. 5). They can also be transferred to differently-configured flat tubes 20, with the embossings preferably present in the cooled area 56. As an alternative, spacer strips similar to insert parts 102 can also be used instead of embossings 96 between every two flat tubes 20 and between the top and bottom flat tubes 20 and the housing 102.

It should also be appreciated that, instead of an insert part 102 such as shown in FIG. 9, the flat tubes themselves may be formed with a shape which extends longitudinally and forms a barrier closing the channels 36 from the uncooled area 58. With such a structure, the tube bottoms on the ends of the heat exchanger may advantageously include corresponding cutouts in order to be able to accommodate flat tubes 20. In addition, such flat tubes 20 could have embossings such as previously described, with both the shaped part and the embossings present on both flat sides (top and bottom) of the flat tubes 20, in which case the shoulder 106 on housing 102 may be superfluous with its function assumed by the formed shape. As in all preceding practical examples, in such a variation, a corrugated internal insert 50 may be inserted in each flat tube 20 in the cooled area 56, and a separation sheet 64 may be provided in one of the collecting tanks 22, 24 (with both variants also usable with either a switching valve 86 integrated in collecting tanks 22, 24 or with two outlet connectors 60 and 62 and an external switch, and a separation sheet 64 designed accordingly).

As previously noted, heat exchangers incorporating the present invention may include more than the two or three flat tubes 20 described in connection with the embodiments disclosed herein. Moreover, such heat exchangers may include several stacks of flat tubes 20, and not just one as illustrated herein. In such cases, the bypass 40 may advantageously be included in at least most of the flat tubes 20 of a single stack, allowing for the possibility of increasing the cross-section of the bypass 40 in comparison with the embodiments illustrated herein.

It should thus be appreciated that heat exchangers incorporating the present invention permit heat exchange with exhaust or charge air, with the possibility of bypass, in a compact design which may be advantageously manufactured. The entire heat exchanger can be joined and produced in a single soldering operation, with the individual parts of the exhaust gas heat exchanger held together by the collecting tanks pushed over the ends of the flat tubes. For the case of the switching valve integrated in the collecting tanks, the corresponding collecting tank is mounted after the soldering process by, for example, welding on.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A heat exchanger, comprising:

flat tubes including cooling passages for a gas and a bypass for said gas separate from said cooling passages;

coolant channels defined between every two flat tubes adjacent said tube passages and spaced from said bypass of said tubes, whereby said tubes define a cooled area adjacent said passages and an uncooled area adjacent said bypass substantially spaced from said channels.

2. The heat exchanger of claim 1, wherein said flat tubes are one piece and stacked one over the other with intermediate spaces forming said channels, and further comprising a housing about said flat tubes.

3. The heat exchanger of claim 2, wherein said flat tubes have embossings spacing adjacent flat tubes.

4. The heat exchanger of claim 2, further comprising inserts between said flat tubes separating said coolant channels from said uncooled area.

5. The heat exchanger of claim 1, wherein said flat tubes are formed from two shaped plates in which said channels and at least one bypass are formed and said heat exchanger is housingless.

6. The heat exchanger of claim 5, wherein said shaped plates include embossings strengthening said channels.

7. The heat exchanger of claim 5, wherein said shaped plates have a continuous lip with which two adjacent plates are connected to each other and said coolant channel is surrounded by said connected lips.

8. The heat exchanger of claim 7, wherein said lip along said uncooled area is wider than said lip on the other sides of said channel.

9. The heat exchanger of claim 1, further comprising an inlet collecting tank and an outlet collecting tank for said gas at the ends of said flat tubes.

10. The heat exchanger of claim 1, further comprising internal inserts in said flat tubes in the cooled area.

11. The heat exchanger of claim 10, wherein said internal inserts are corrugated and each form discrete flow passages for said gas.

12. The heat exchanger of claim 11, wherein the discrete flow passage adjacent the bypass is substantially blocked to gas flow to suppress heat transfer between said cooled area and said uncooled area.

13. The heat exchanger of claim 10, further comprising an inlet collecting tank and an outlet collecting tank for said gas at the ends of said flat tubes, wherein said bypass and cooled area are separated by a portion of said internal inserts and a separation sheet in one of said inlet and outlet collecting tanks.

14. The heat exchanger of claim 13, wherein said separation sheet is an integral part of the collecting tank.

* * * * *